US009617119B2

(12) United States Patent
Maruyama

(10) Patent No.: US 9,617,119 B2
(45) Date of Patent: Apr. 11, 2017

(54) ELEVATOR APPARATUS

(75) Inventor: Naoyuki Maruyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 241 days.

(21) Appl. No.: 14/362,698

(22) PCT Filed: Dec. 7, 2011

(86) PCT No.: PCT/JP2011/078267
§ 371 (c)(1),
(2), (4) Date: Jun. 4, 2014

(87) PCT Pub. No.: WO2013/084310
PCT Pub. Date: Jun. 13, 2013

(65) Prior Publication Data
US 2015/0021122 A1 Jan. 22, 2015

(51) Int. Cl.
*B66B 9/00* (2006.01)
*B66B 11/00* (2006.01)
*B66B 7/00* (2006.01)

(52) U.S. Cl.
CPC ..... *B66B 9/00* (2013.01); *B66B 7/00* (2013.01); *B66B 11/008* (2013.01); *B66B 11/0045* (2013.01)

(58) Field of Classification Search
CPC ..... B66B 9/00; B66B 7/00; B66B 11/0045; B66B 11/008
USPC ..... 187/266
See application file for complete search history.

(56) References Cited

U.S. PATENT DOCUMENTS 3,101,130 A * 8/1963 Bianca ..... B66B 11/08 187/244
5,429,211 A 7/1995 Aulanko et al.
5,490,578 A 2/1996 Aulanko et al.
5,899,300 A * 5/1999 Miller ..... B66B 7/02 187/256

(Continued)

FOREIGN PATENT DOCUMENTS

EP 1 422 183 A1 5/2004
JP 7-10434 1/1995

(Continued)

OTHER PUBLICATIONS

International Search Report issued Apr. 17, 2012, in PCT/JP2011/078267, filed Dec. 7, 2011.

*Primary Examiner* — Michael Riegelman
(74) *Attorney, Agent, or Firm* — Oblon, McClelland, Maier & Neustadt, L.L.P.

(57) ABSTRACT

In an elevator apparatus, a hoisting machine includes a driving sheave, and a motor portion that rotates the driving sheave, and is disposed in an upper portion inside a hoistway. A suspending unit is wound sequentially around a first car suspending sheave, a second car suspending sheave, the driving sheave, and a counterweight suspending sheave. The second car suspending sheave, the driving sheave, and the counterweight suspending sheave are disposed on a first side of a car guide rail center line that connects first and second car guide rails when viewed from directly above. A portion of the motor portion is disposed between a back surface of the second car guide rail and a hoistway wall. The driving sheave is disposed so as to overlap with the second car guide rail when viewed from a landing side.

12 Claims, 8 Drawing Sheets

(56) References Cited

U.S. PATENT DOCUMENTS

| | | | | |
|---|---|---|---|---|
| 8,020,669 | B2 * | 9/2011 | Aulanko | B66B 7/06 187/254 |
| 2004/0216958 | A1 * | 11/2004 | Ach | B66B 7/062 187/254 |
| 2005/0087398 | A1 * | 4/2005 | Aulanko | B66B 19/00 187/254 |
| 2005/0269162 | A1 * | 12/2005 | Higashi | B66B 11/0045 187/277 |
| 2007/0170005 | A1 * | 7/2007 | Kigawa | B66B 11/008 187/254 |
| 2007/0227832 | A1 * | 10/2007 | Aulanko | B66B 11/008 187/406 |
| 2012/0085594 | A1 * | 4/2012 | Wright | B66B 11/008 187/266 |
| 2014/0027207 | A1 * | 1/2014 | Yapar | B66B 11/008 187/254 |

FOREIGN PATENT DOCUMENTS

| | | |
|---|---|---|
| JP | 2777340 | 7/1998 |
| JP | 2000-153973 | 6/2000 |
| JP | 2002-145555 | 5/2002 |
| JP | 2004-83231 | 3/2004 |
| WO | 03/020628 A1 | 3/2003 |

* cited by examiner

ELEVATOR APPARATUS

TECHNICAL FIELD

The present invention relates to a machine-roomless elevator apparatus in which a hoisting machine that raises and lowers a car is disposed in an upper portion inside a hoistway.

BACKGROUND ART

In conventional machine-roomless elevator apparatuses, a thin-type hoisting machine is disposed between a space that includes a hoisting zone of a car and an extension thereof and a hoistway wall. In this configuration, car suspending sheaves are disposed on opposite sides of a car guide rail on an opposite side from a counterweight. Because of that, a driving sheave and a motor portion of the hoisting machine are disposed behind one of the car guide rails of a pair of car guide rails (see Patent Literature 1 and 2, for example).

In other conventional machine-roomless elevator apparatuses, car suspending sheaves are disposed on a side near a counterweight relative to a car guide rail. In this configuration, a hoisting machine is disposed between a pair of counterweight guide rails in an upper portion of a hoisting zone of the counterweight when viewed from directly above. A counterweight-side rope fastener portion is disposed directly below the hoisting machine.

CITATION LIST

Patent Literature

[Patent Literature 1]
Japanese Patent No. 2593288 (Gazette)
[Patent Literature 2]
Japanese Patent No. 2777340 (Gazette)

SUMMARY OF THE INVENTION

Problem to be Solved by the Invention

In conventional elevator apparatuses such as those that are disclosed in Patent Literature 1 and 2, since a driving sheave and a motor portion are disposed behind a car guide rail, one problem has been that horizontal space in the hoistway is increased. In the other conventional elevator apparatuses, since a counterweight-side rope fastener portion is disposed directly below the hoisting machine, a beam on which to mount the rope fastener portion is required separately from a beam that supports the hoisting machine, increasing the number of parts. Furthermore, since two layers of beams are disposed above the counterweight while ensuring counterweight hoisting space, it is necessary to increase vertical dimensions of the hoistway.

The present invention aims to solve the above problems and an object of the present invention is to provide an elevator apparatus that enables horizontal and vertical space saving in a hoistway by disposing a hoisting machine inside the hoistway more efficiently.

Means for Solving the Problem

In order to achieve the above object, according to one aspect of the present invention, there is provided an elevator apparatus including: a car on which first and second car suspending sheaves are disposed, and that is raised and lowered inside a hoistway; first and second car guide rails that are installed inside the hoistway so as to guide the raising and lowering of the car; a counterweight on which a counterweight suspending sheave is disposed, and that is raised and lowered inside the hoistway; first and second counterweight guide rails that are installed inside the hoistway so as to guide the raising and lowering of the counterweight; a hoisting machine that includes: a driving sheave; and a motor portion that rotates the driving sheave, the hoisting machine being disposed in an upper portion inside the hoistway so as to raise and lower the car and the counterweight; a suspending means that includes a car-side end portion and a counterweight-side end portion, and that is wound sequentially around the first car suspending sheave, the second car suspending sheave, the driving sheave, and the counterweight suspending sheave to suspend the car and the counterweight; a car-side rope fastener portion that is disposed in the upper portion inside the hoistway, and to which the car-side end portion is connected; and a counterweight-side rope fastener portion that is disposed in the upper portion inside the hoistway, and to which the counterweight-side end portion is connected, wherein: the second car suspending sheave, the driving sheave, and the counterweight suspending sheave are disposed on a first side of a car guide rail center line that connects the first and second car guide rails when viewed from directly above; a portion of the motor portion is disposed between a back surface of the second car guide rail and a hoistway wall; and the driving sheave is disposed so as to overlap with the second car guide rail when viewed from a landing side.

Effects of the Invention

In an elevator apparatus according to the present invention, because the second car suspending sheave, the driving sheave, and the counterweight suspending sheave are disposed on a first side of a car guide rail center line that connects the first and second car guide rails when viewed from directly above, and a portion of the motor portion is disposed between a back surface of the second car guide rail and a hoistway wall, and the driving sheave is disposed so as to overlap with the second car guide rail when viewed from a landing side, horizontal and vertical space saving can be achieved in the hoistway by disposing the hoisting machine inside the hoistway more efficiently.

BRIEF DESCRIPTION OF THE DRAWINGS

FIG. 3 is an oblique projection that shows the elevator apparatus in FIG. 1 from obliquely side-on;

DESCRIPTION OF EMBODIMENTS

Preferred embodiments of the present invention will now be explained with reference to the drawings.

Embodiment 1

Figure 1:
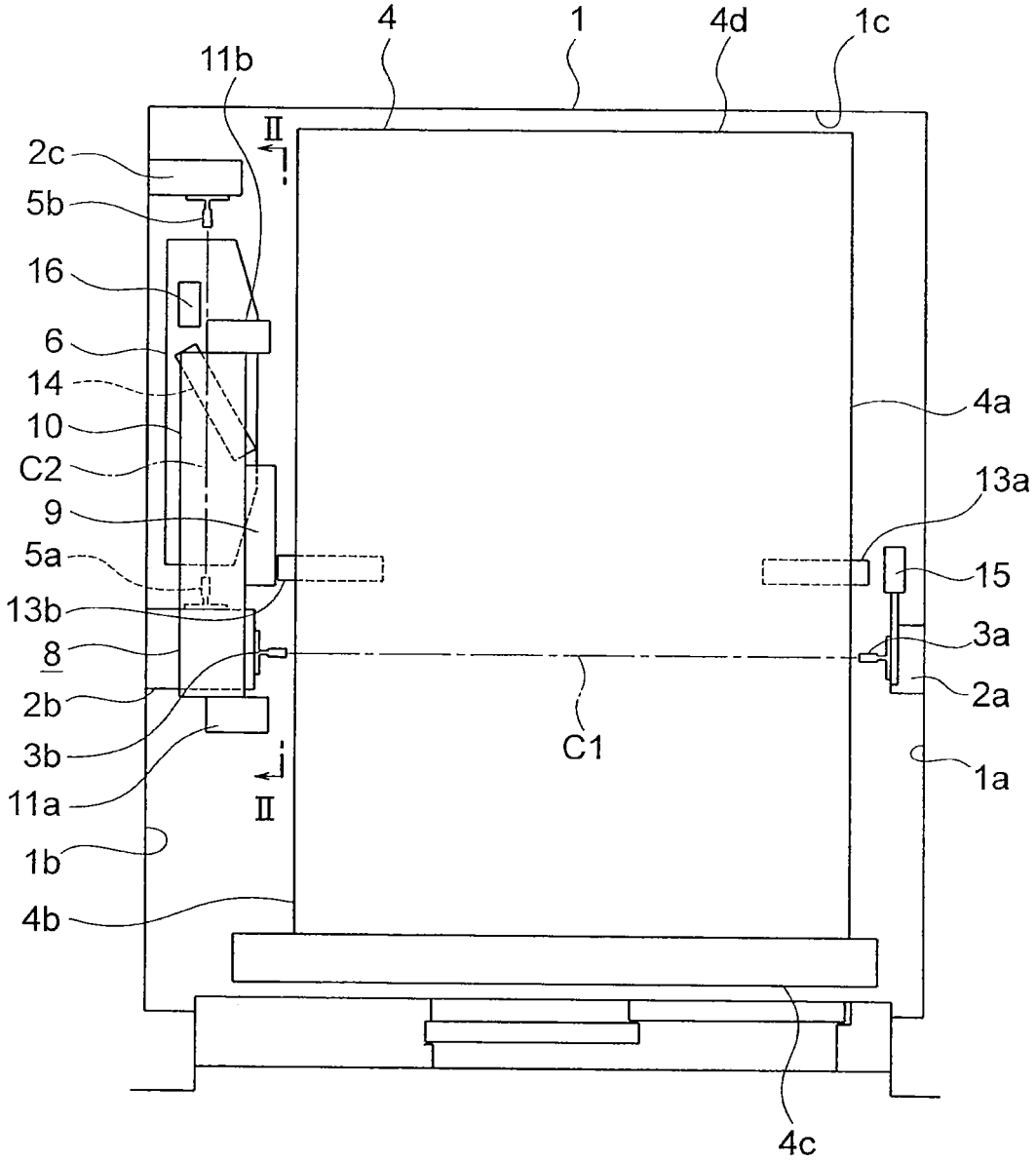
FIG. 1 is a plan that shows an elevator apparatus according to Embodiment 1 of the present invention.
Figure 2:
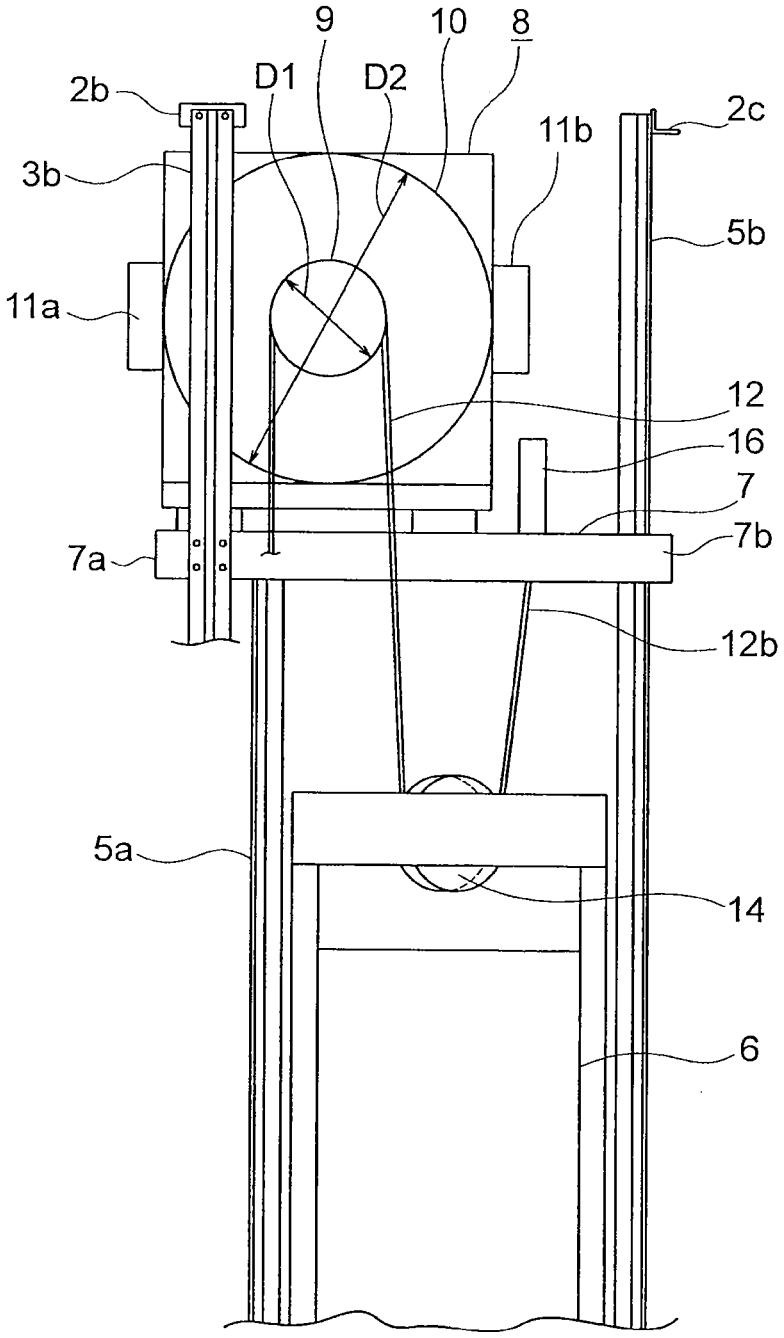
FIG. 2 is a cross section that is taken along Line II-II in FIG. 1.
Figure 3:
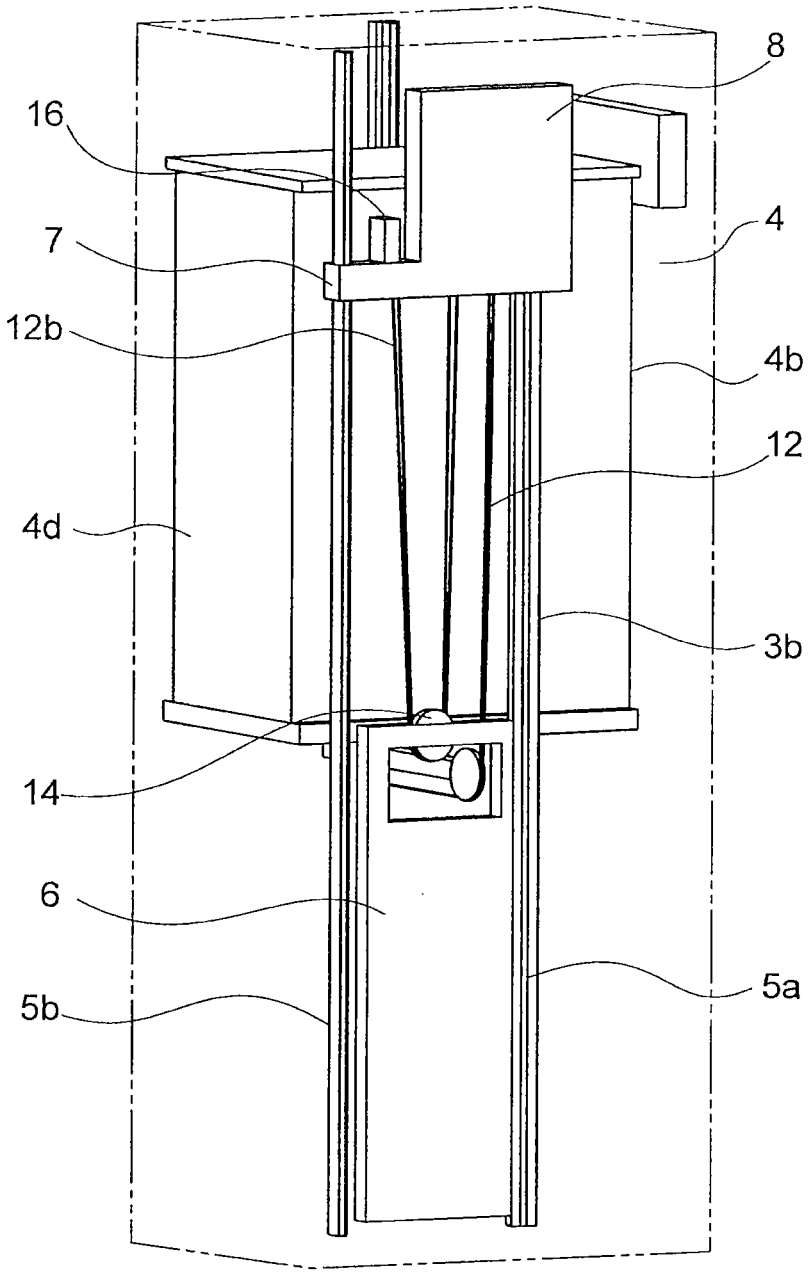
Figure 4:
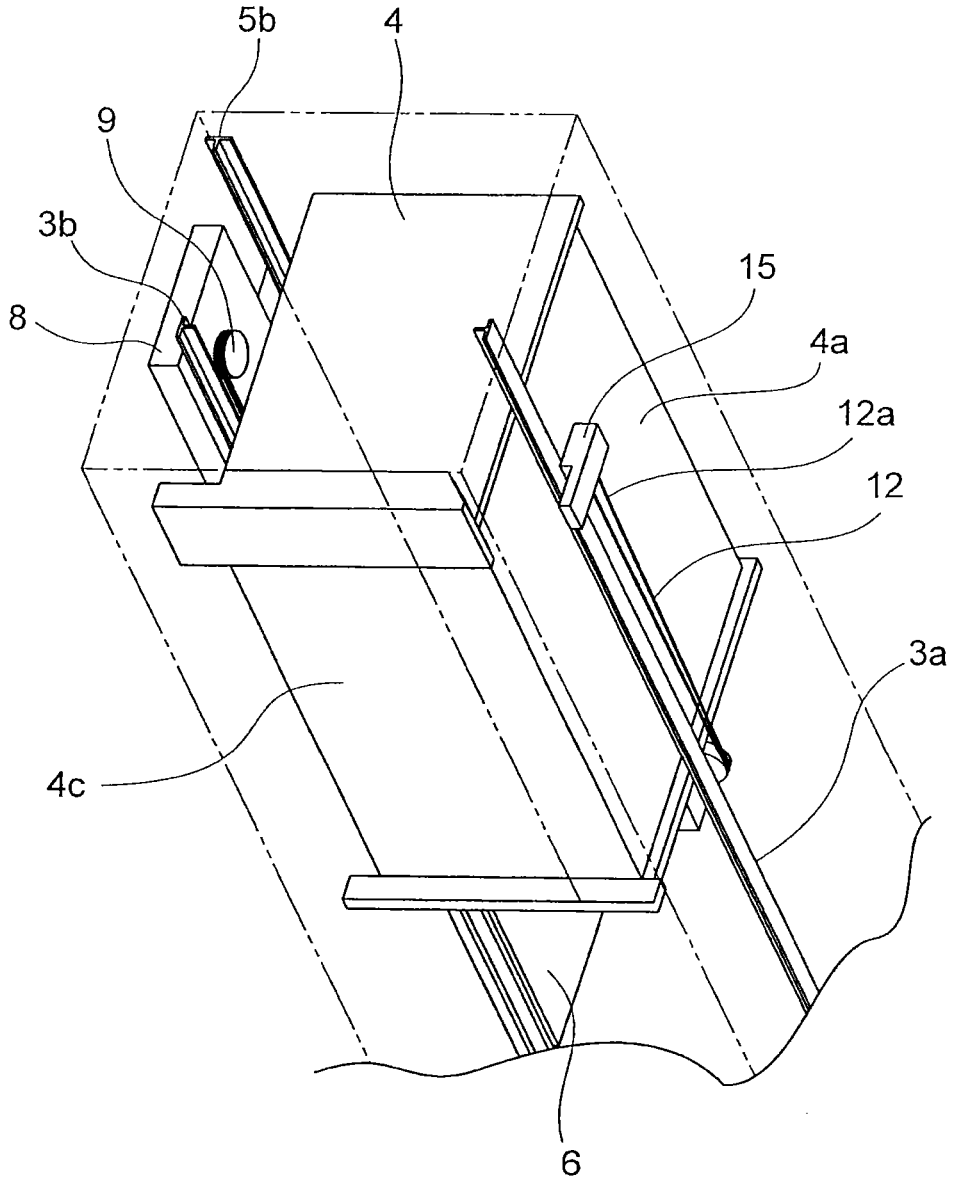
FIG. 4 is an oblique projection that shows the elevator apparatus in FIG. 1 from obliquely above.

FIG. 1 is a plan that shows an elevator apparatus according to Embodiment 1 of the present invention, FIG. 2 is a cross section that is taken along Line II-II in FIG. 1, FIG. 3 is an oblique projection that shows the elevator apparatus in FIG. 1 from obliquely side-on, and FIG. 4 is an oblique projection that shows the elevator apparatus in FIG. 1 from obliquely above.

In the figures, a hoistway 1 includes: first and second hoistway walls 1*a* and 1*b* that face each other; and a third hoistway wall 1*c* that is positioned on an opposite side from landings.

A plurality of first rail brackets 2*a* are installed on the first hoistway wall 1*a* so as to be spaced apart from each other vertically. A first car guide rail 3*a* is fastened to the first rail brackets 2*a*. A plurality of second rail brackets 2*b* are installed on the second hoistway wall 1*b* so as to be spaced apart from each other vertically. A second car guide rail 3*b* is fastened to the second rail brackets 2*b*.

A car 4 is disposed between the first and second car guide rails 3*a* and 3*b*, and is raised and lowered inside the hoistway 1 so as to be guided by the first and second car guide rails 3*a* and 3*b*. The car 4 includes: first and second car side surfaces 4*a* and 4*b* that face each other; a car front surface 4*c* on which a car doorway is disposed; and a car back surface 4*d* that faces the car front surface 4*c*.

The first car side surface 4*a* faces the first hoistway wall 1*a*. The second car side surface 4*b* faces the second hoistway wall 1*b*. The car back surface 4*d* faces the third hoistway wall 1*c*.

The first and second car guide rails 3*a* and 3*b* are disposed at identical positions in a depth direction of the car 4 (a vertical direction in FIG. 1). A car guide rail center line C1 that connects the first and second car guide rails 3*a* and 3*b* is parallel to a width direction of the car 4 (a lateral direction in FIG. 1) when viewed from directly above.

A first counterweight guide rail 5*a* is fastened to the second rail brackets 2*b*. A plurality of third rail brackets 2*c* are installed on the second hoistway wall 1*b* so as to be spaced apart from each other vertically. A second counterweight guide rail 5*b* is fastened to the third rail brackets 2*c*.

The first and second counterweight guide rails 5*a* and 5*b* are disposed between the second car side surface 4*b* and the second hoistway wall 1*b* when viewed from directly above. A counterweight guide rail center line C2 that connects the first and second counterweight guide rails 5*a* and 5*b* is perpendicular to the car guide rail center line C1 when viewed from directly above.

A counterweight 6 is disposed between the first and second counterweight guide rails 5*a* and 5*b*, and is raised and lowered inside the hoistway 1 so as to be guided by the first and second counterweight guide rails 5*a* and 5*b*. The counterweight 6 faces the second car side surface 4*b* when positioned level with the car 4. In addition, the counterweight 6 is disposed between the second car side surface 4*b* and the second hoistway wall 1*b*, that is, beside the car 4, when viewed from directly above.

A hoisting machine supporting beam 7 (omitted from FIG. 1) is mounted onto an upper end surface of the first counterweight guide rail 5*a*. The hoisting machine supporting beam 7 is disposed horizontally parallel to the depth direction of the car 4 directly above the counterweight 6. The hoisting machine supporting beam 7 includes: a first supporting beam end portion 7*a* that is positioned forward in the depth direction of the car 4; and a second supporting beam end portion 7*b* that is positioned rearward.

The first supporting beam end portion 7*a* is fastened to a back surface of the second car guide rail 3*b*. The second counterweight guide rail 5*b* passes through the second supporting beam end portion 7*b*. The second supporting beam end portion 7*b* is fastened to a back surface of the second counterweight guide rail 5*b*. The hoisting machine supporting beam 7 is supported by the second car guide rail 3*b* and by the first and second counterweight guide rails 5*a* and 5*b*.

A hoisting machine 8 that raises and lowers the car 4 and the counterweight 6 is installed on the hoisting machine supporting beam 7. The hoisting machine 8 includes: a cylindrical driving sheave 9; a cylindrical motor portion 10 that rotates the driving sheave 9; and a plurality of (in this case, a pair of) brakes 11*a* and 11*b* that brake the rotation of the driving sheave 9. The hoisting machine 8 is disposed directly above the counterweight 6 in an upper portion inside the hoistway 1. In addition, the hoisting machine 8 is disposed between the second car side surface 4*b* and the second hoistway wall 1*b* such that at least a portion thereof overlaps with the counterweight 6 when viewed from directly above.

A suspending means 12 (omitted from FIG. 1) that suspends the car 4 and the counterweight 6 is wound around the driving sheave 9. A plurality of ropes or a plurality of belts are used as the suspending means 12. The car 4 and the counterweight 6 are suspended inside the hoistway 1 by the suspending means 12 so as to be raised and lowered inside the hoistway 1 by the hoisting machine 8.

A diameter D1 of the driving sheave 9 is less than or equal to half of a diameter D2 of the motor portion 10 (rotor outside diameter if it is an outer-rotor type, stator outside diameter if it is an inner-rotor type). A small-diameter driving sheave 9 of this kind is made feasible by using high-strength, high-flexibility resin-coated ropes or small-gauge ropes, for example, as the suspending means 12.

First and second car suspending sheaves 13*a* and 13*b* are disposed on a lower portion of the car 4. The suspending means 12 is wound around the first and second car suspending sheaves 13*a* and 13*b*. The first and second car suspending sheaves 13*a* and 13*b* are disposed at identical positions in the depth direction of the car 4.

Rotating shafts of the first and second car suspending sheaves 13*a* and 13*b* are horizontal and parallel to the depth direction of the car 4. A portion of the suspending means 12 that passes between the first and second car suspending sheaves 13*a* and 13*b* is thereby parallel to the car guide rail center line C1 when viewed from directly above. The first car suspending sheave 13*a* is disposed directly below the first car side surface 4*a*, and the second car suspending sheave 13*b* is disposed directly below the second car side surface 4*b*.

A counterweight suspending sheave 14 is disposed on an upper portion of the counterweight 6. The suspending means 12 is wound around the counterweight suspending sheave 14. The counterweight suspending sheave 14 intersects the counterweight guide rail center line C2 obliquely when viewed from directly above.

A car rope fastener portion 15 is disposed in a vicinity of an upper end portion of the first car guide rail 3*a*. A counterweight-side rope fastener portion 16 is disposed on the hoisting machine supporting beam 7. The counterweight-side rope fastener portion 16 is disposed between the hoisting machine 8 and the second counterweight guide rail 5*b*.

The suspending means 12 includes: a car-side end portion 12*a* that is connected to the car rope fastener portion 15; and a counterweight-side end portion 12*b* that is connected to the counterweight-side rope fastener portion 16. The suspending means 12 is wound from near the car-side end portion 12*a* sequentially around the first car suspending sheave 13*a*, the second car suspending sheave 13*b*, the driving sheave 9, and the counterweight suspending sheave 14. In other words, the car 4 is suspended using a two-to-one (2:1) roping method.

In Embodiment 1, the first car suspending sheave 13*a*, the second car suspending sheave 13*b*, the driving sheave 9, the counterweight 6, and the counterweight suspending sheave 14 are disposed on a first side of the car guide rail center line C1 (rearward in the depth direction of the car 4) when viewed from directly above. In other words, the counterweight 6 is disposed on an identical side of the car guide rail center line C1 to the driving sheave 9 when viewed from directly above.

A portion of the motor portion 10 is disposed between the back surface of the second car guide rail 3*b* and the second hoistway wall 1*b*. In addition, the driving sheave 9 is disposed so as to overlap with the second car guide rail 3*b* when viewed from a landing side.

Furthermore, the driving sheave 9 is disposed on a side of the motor portion 10 near the car 4. Thus, an end surface of the driving sheave 9 near the car 4 is positioned nearer to the motor portion 10 than an end surface of the second car guide rail 3*b* near the car 4 (a head surface). Because of that, the driving sheave 9 does not protrude beyond the second car guide rail 3*b* toward the car 4 when viewed from the landing side.

The brakes 11*a* and 11*b* are disposed on an outer circumferential portion of the motor portion 10 so as to face each other horizontally. In addition, the brakes 11*a* and 11*b* are disposed so as to overlap with the second car guide rail 3*b* when viewed from a landing side.

Furthermore, the driving sheave 9 and one of the brakes 11*a* face each other from opposite sides of the second car guide rail 3*b* when viewed from directly above. In other words, the motor portion 10 is disposed behind the second car guide rail 3*b*, the driving sheave 9 is disposed on a first side of the second car guide rail 3*b*, and the brake 11*a* is disposed on a second side of the second car guide rail 3*b*. To put it another way, a portion of the second car guide rail 3*b* is disposed inside a recess portion that is formed by the motor portion 10, the driving sheave 9, and the brake 11*a* when viewed from directly above.

Suspended loads that act on the driving sheave 9 and the counterweight-side rope fastener portion 16 are supported by the hoisting machine supporting beam 7. A portion of the suspending means 12 between the driving sheave 9 and the second car suspending sheave 13*b* passes between the second car side surface 4*b* and the second hoistway wall 1*b* further rearward in the depth direction of the car 4 than the second car guide rail 3*b*.

In an elevator apparatus of this kind, because the motor portion 10 is disposed behind the second car guide rail 3*b*, and the driving sheave 9 is disposed beside the second car guide rail 3*b*, dimensions between the second car guide rail 3*b* and the second hoistway wall 1*b* can be reduced compared to when the entire hoisting machine 8 is disposed behind the second car guide rail 3*b*. Because of that, the hoisting machine 8 is disposed inside the hoistway 1 more efficiently, enabling horizontal space saving to be achieved in the hoistway 1.

Since the motor portion 10 is disposed closer to the second car guide rail 3*b*, the counterweight-side rope fastener portion 16 can be disposed beside the hoisting machine 8 while disposing the hoisting machine 8 directly above the counterweight 6, enabling the counterweight-side rope fastener portion 16 to be disposed within a height limit of the hoisting machine 8. Because of that, the hoisting machine 8 is disposed inside the hoistway 1 more efficiently, enabling vertical space saving also to be achieved in the hoistway 1.

In addition, because the driving sheave 9, which has a diameter that is less than or equal to half of the diameter of the motor portion 10, is disposed closer to the second car guide rail 3*b*, spacing between the first car suspending sheave 13*a* and the first car guide rail 3*a* and spacing between the second car suspending sheave 13*b* and the second car guide rail 3*b* can be reduced even with a small-diameter driving sheave 9.

Because of that, eccentricity of the center of suspension of the car 4 relative to the car guide rail center line C1 due to the suspending means 12 is reduced, enabling moment loads that act on the car guide rails 3*a* and 3*b* to be reduced, thereby enabling increases in the size of the car guide rails 3*a* and 3*b* to be prevented. A configuration of this kind is particularly effective for a thin-type hoisting machine 8 that has a driving sheave 9 in which diameter is reduced using high-strength, high-flexibility ropes.

Because the counterweight 6 is disposed beside the car 4, and at least a portion of the hoisting machine 8 is disposed so as to overlap with the counterweight 6 when viewed from directly above, a return sheave is not required, enabling the number of parts to be suppressed, and horizontal space saving to be achieved, compared to a configuration such as that shown in FIG. 7 (described below).

In addition, because the counterweight-side rope fastener portion 16 is supported by the hoisting machine supporting beam 7, it is not necessary to dispose a beam to support the counterweight-side rope fastener portion 16 separately, enabling the number of parts to be reduced.

Furthermore, because the driving sheave 9 is disposed on a side of the motor portion 10 near the car 4, and the end surface of the driving sheave 9 near the car 4 is positioned nearer to the motor portion 10 than the end surface of the second car guide rail 3*b* near the car 4, the hoisting machine 8 and the suspending means 12 are disposed more efficiently, enabling horizontal space saving to be achieved in the hoistway 1.

Because the driving sheave 9 and the brake 11*a* face each other from opposite sides of the second car guide rail 3*b* when viewed from directly above, the hoisting machine 8 is disposed more efficiently, enabling horizontal space saving to be achieved in the hoistway 1.

Embodiment 2

Figure 5:
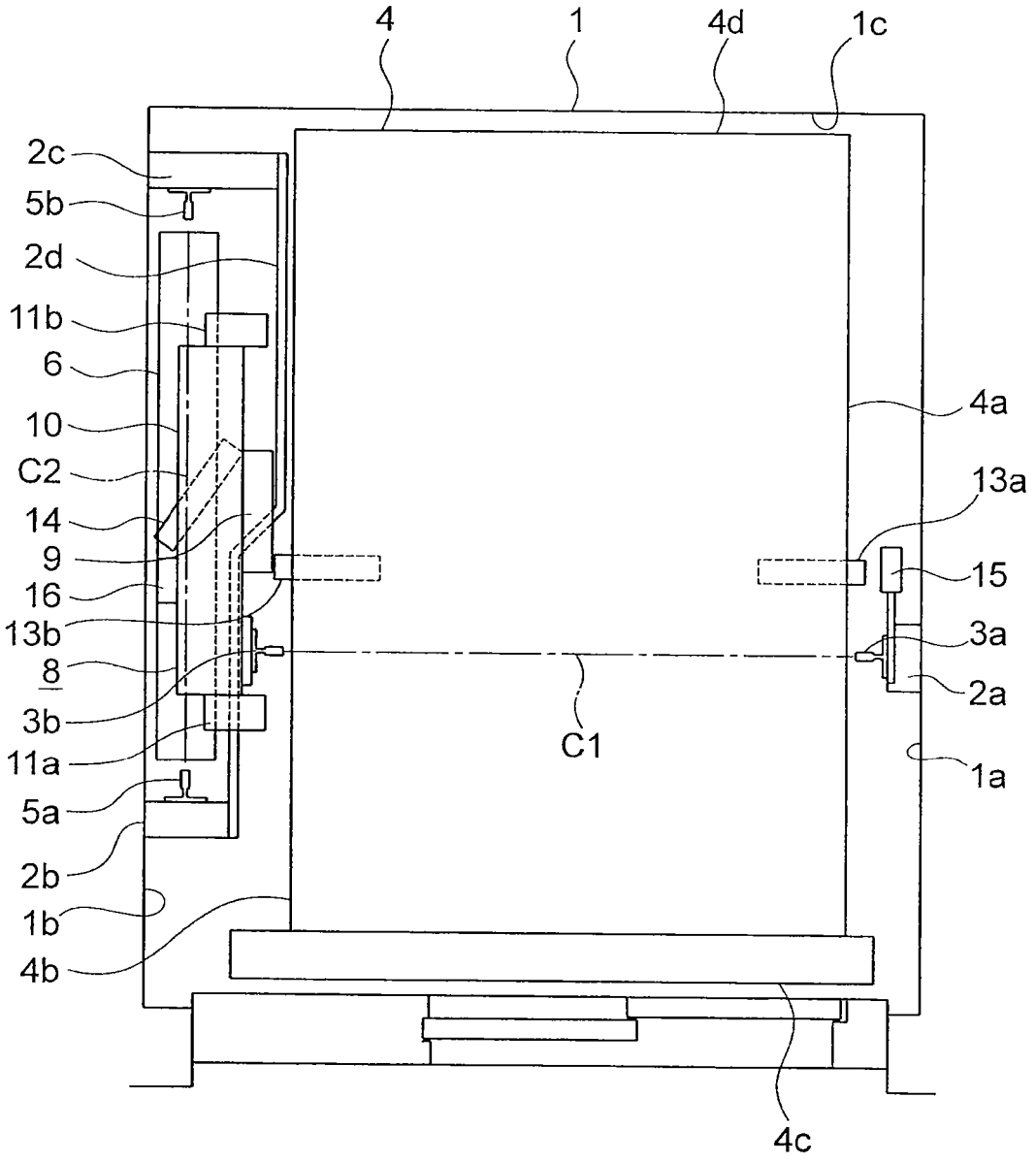
FIG. 5 is a plan that shows an elevator apparatus according to Embodiment 2 of the present invention.

Next, FIG. 5 is a plan that shows an elevator apparatus according to Embodiment 2 of the present invention. In the figure, respective second rail brackets 2*b* are fixed to a second hoistway wall 1*b* further forward in a depth direction of a car 4 than a car guide rail center line C1 when viewed from directly above. Strip-shaped linking brackets 2*d* are connected between the respective second rail brackets 2*b* and respective third rail brackets 2*c*. Portal brackets that surround a counterweight 6 together with the second hoistway wall 1*b* are constituted by these brackets 2*b*, 2*c*, and 2*d*.

The second car guide rail 3*b* is fastened to the linking brackets 2*d*. A portion of the counterweight 6 is disposed behind a second car guide rail 3*b*, that is, between the second car guide rail 3*b* and the second hoistway wall 1*b*.

A counterweight suspending sheave 14 is disposed between a driving sheave 9 and the second hoistway wall 1*b* when viewed from directly above. A counterweight-side rope fastener portion 16 is disposed on a lower portion of the hoisting machine 8, that is, on a lower portion of a hoisting machine supporting beam 7. The rest of the configuration is similar or identical to that of Embodiment 1.

In a layout of this kind, since the counterweight-side rope fastener portion 16 lines up with the hoisting machine 8 vertically, vertical space that is occupied by the hoisting machine 8 and the counterweight-side rope fastener portion 16 is greater than in Embodiment 1. However, since spacing between the counterweight guide rails 5*a* and 5*b* is greater than in Embodiment 1, width dimensions of the counterweight 6 can be increased, and thickness dimensions reduced, enabling space saving to be achieved in horizontal directions of the hoistway 1.

Since spacing between the counterweight guide rails 5*a* and 5*b* can be further increased if depth dimensions (front-to-rear dimensions) of the car 4 are large, height dimensions of the counterweight 6 can be reduced, enabling vertical space saving of the hoistway 1 to be achieved even if the hoisting machine 8 and the counterweight-side rope fastener portion 16 line up vertically.

Embodiment 3

Figure 6:
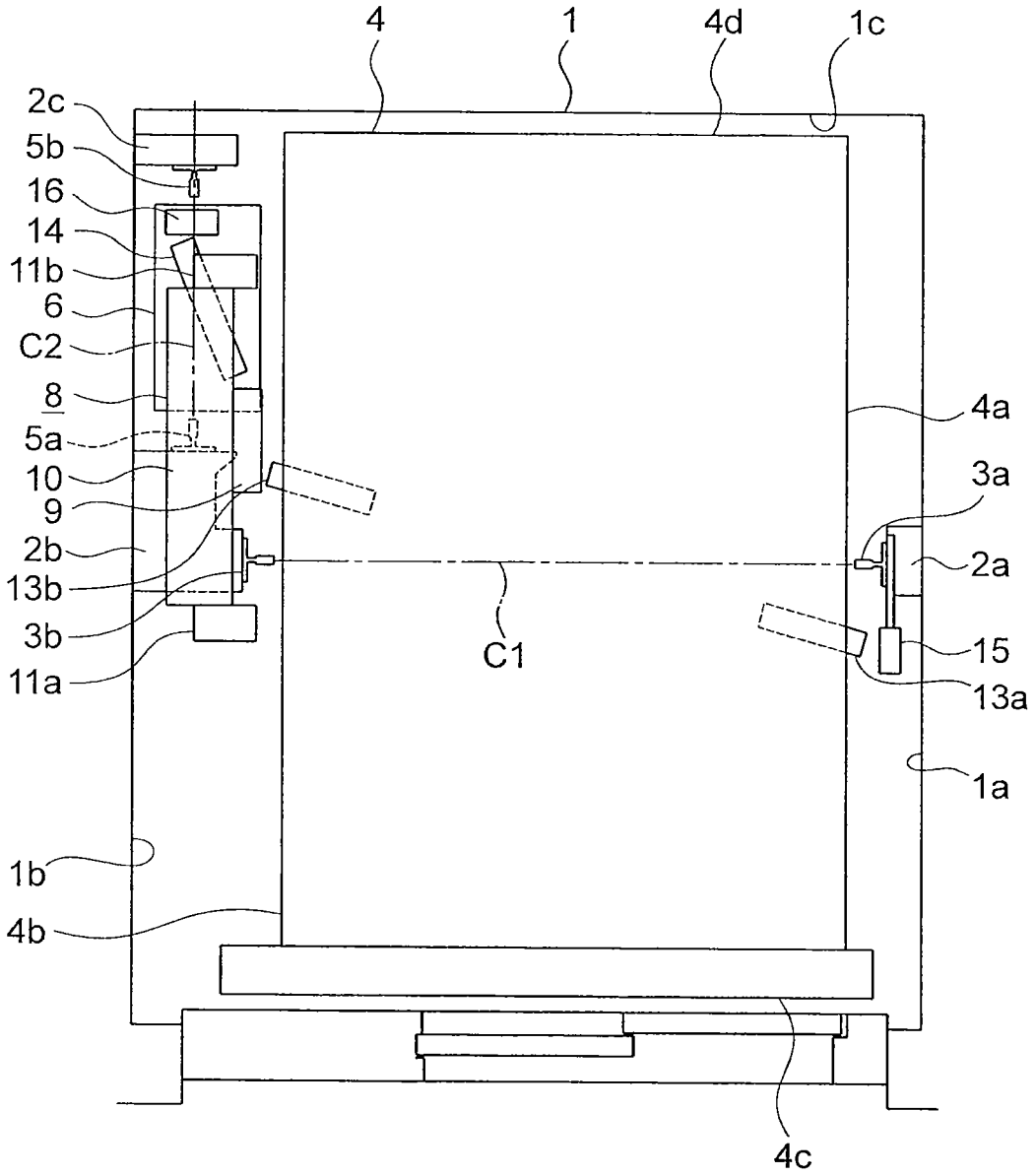
FIG. 6 is a plan that shows an elevator apparatus according to Embodiment 3 of the present invention.

Next, FIG. 6 is a plan that shows an elevator apparatus according to Embodiment 3 of the present invention. In the figure, a second car suspending sheave 13*b* is disposed on an opposite side of a car guide rail center line C1 from a first car suspending sheave 13*a* when viewed from directly above. Specifically, the first car suspending sheave 13*a* is disposed further forward on a car 4 than the car guide rail center line C1, and the second car suspending sheave 13*b* is disposed further rearward on the car 4 than the car guide rail center line C1.

Rotating shafts of the first and second car suspending sheaves 13*a* and 13*b* are horizontal and inclined relative to a depth direction of the car 4. A portion of the suspending means 12 that passes between the first and second car suspending sheaves 13*a* and 13*b* thereby intersects the car guide rail center line C1 obliquely when viewed from directly above. The first and second car suspending sheaves 13*a* and 13*b* are disposed so as to have point symmetry centered about a point of intersection between a center line in a width direction of a car 4 and the car guide rail center line C1 when viewed from directly above.

A portion of the suspending means 12 between a driving sheave 9 and the second car suspending sheave 13*b* passes between a second car side surface 4*b* and a second hoistway wall 1*b* further rearward in the depth direction of the car 4 than the second car guide rail 3*b*, and further forward in the depth direction of the car 4 than a first counterweight guide rail 5*a*. The rest of the configuration is similar or identical to that of Embodiment 1.

According to a layout of this kind, the hoisting machine 8 is also disposed inside the hoistway 1 more efficiently, enabling horizontal and vertical space saving to be achieved in the hoistway 1.

Since the first and second car suspending sheaves 13*a* and 13*b* are disposed obliquely on opposite sides of the car guide rail center line C1 from each other, the center of suspension of the car 4 by the suspending means 12 can be placed closer to a center of gravity of the car 4, enabling moment loads that act on the car guide rails 3*a* and 3*b* to be reduced maximally (or eliminated), thereby enabling increases in the size of the car guide rails 3*a* and 3*b* to be prevented.

Embodiment 4

Figure 7:
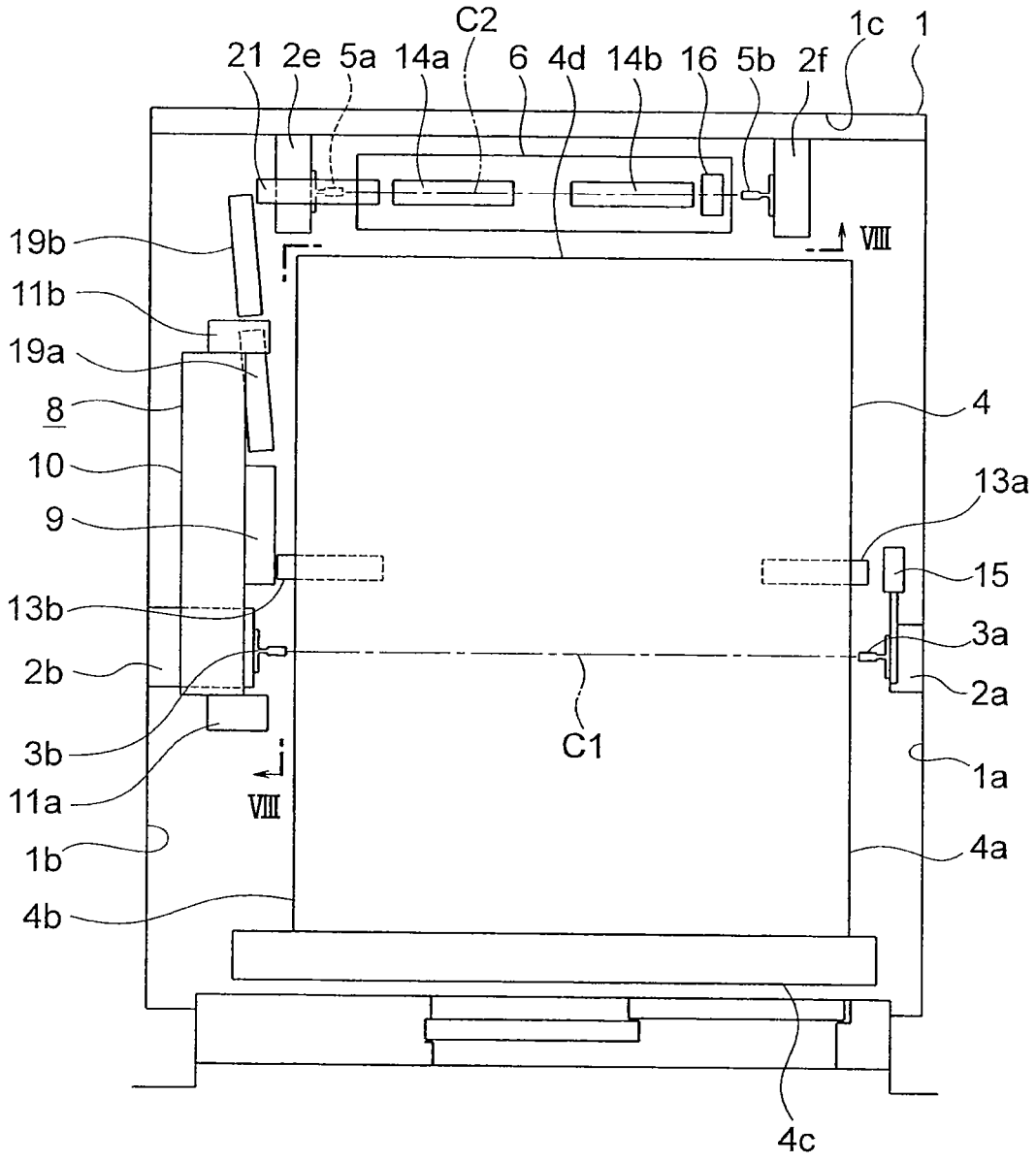
FIG. 7 is a plan that shows an elevator apparatus according to Embodiment 4 of the present invention.
Figure 8:
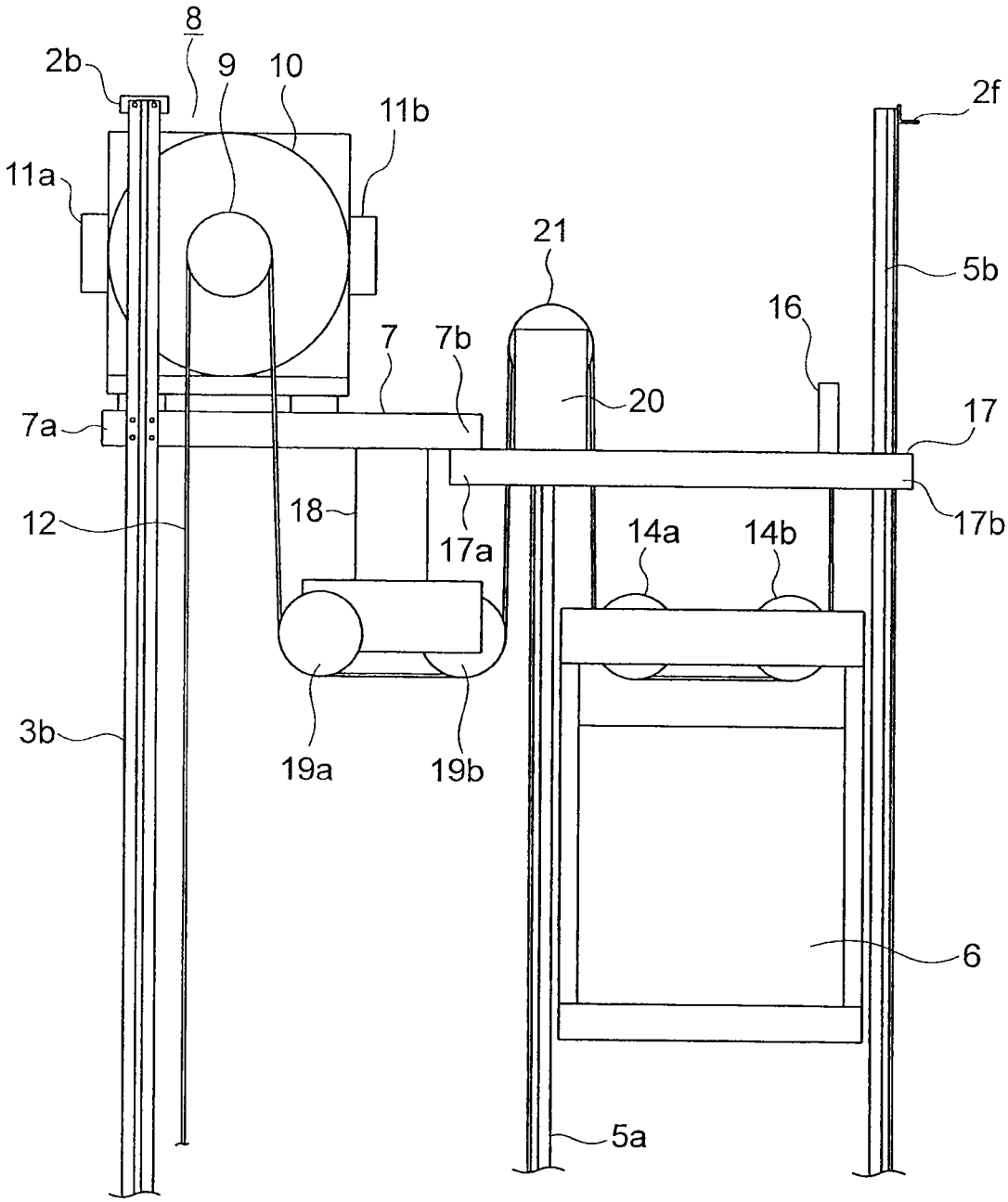
FIG. 8 is a cross section that is taken along Line VIII-VIII in FIG. 7.

Next, FIG. 7 is a plan that shows an elevator apparatus according to Embodiment 4 of the present invention, and FIG. 8 is a cross section that is taken along Line VIII-VIII in FIG. 7. In the figures, a plurality of third rail brackets 2*e* are installed on a third hoistway wall 1*c* so as to be spaced apart from each other vertically, and a plurality of fourth rail brackets 2*f* are also installed on the third hoistway wall 1*c* so as to be spaced apart from each other vertically.

A first counterweight guide rail 5*a* is fastened to the third rail brackets 2*e*. A second counterweight guide rail 5*b* is fastened to the fourth rail brackets 2*f*.

The first and second counterweight guide rails 5*a* and 5*b* are disposed between a car back surface 4*d* and the third hoistway wall 1*c* when viewed from directly above. A counterweight guide rail center line C2 that connects the first and second counterweight guide rails 5*a* and 5*b* is parallel to a car guide rail center line C1 when viewed from directly above.

A counterweight 6 faces the car back surface 4*d* when positioned level with the car 4. The counterweight 6 is disposed between the car back surface 4*d* and the third hoistway wall 1*c*, that is, behind the car 4, when viewed from directly above.

A counterweight-side supporting beam 17 (omitted from FIG. 7) is mounted onto an upper end surface of the first counterweight guide rail 5*a*. The counterweight-side supporting beam 17 is disposed horizontally parallel to a width direction of the car 4 directly above the counterweight 6. The counterweight-side supporting beam 17 includes: a first supporting beam end portion 17*a* that is positioned near the second hoistway wall 1*b* in the width direction of the car 4; and a second supporting beam end portion 17*b* that is positioned near the first hoistway wall 1*a*.

The second counterweight guide rail 5*b* passes through the second supporting beam end portion 17*b*. The second supporting beam end portion 17*b* is fastened to a back surface of the second counterweight guide rail 5*b*.

A first supporting beam end portion 7*a* of a hoisting machine supporting beam 7 (omitted from FIG. 7) is fastened to a back surface of the second car guide rail 3*b*. The second supporting beam end portion 7*b* of the hoisting machine supporting beam 7 is connected onto the first supporting beam end portion 17*a* of the counterweight-side supporting beam 17.

The hoisting machine supporting beam 7 is connected so as to be perpendicular to the counterweight-side supporting beam 17. The hoisting machine supporting beam 7 and the counterweight-side supporting beam 17 are supported by the second car guide rail 3*b* and by the first and second counterweight guide rails 5*a* and 5*b*.

The first and second sheave-side return sheaves 19*a* and 19*b* are supported on a lower portion of the hoisting machine supporting beam 7 by means of a first supporting arm 18 (omitted from FIG. 7). The first and second sheave-side return sheaves 19*a* and 19*b* are disposed lower than the driving sheave 9 in the upper portion inside the hoistway 1.

The first and second sheave-side return sheaves 19*a* and 19*b* are disposed between the second car side surface 4*b* and the second hoistway wall 1*b* when viewed from directly above. Rotating shafts of the first and second sheave-side return sheaves 19*a* and 19*b* are horizontal and inclined slightly relative to a straight line that is parallel to the rotating shaft of the driving sheave 9.

First and second counterweight suspending sheaves 14*a* and 14*b* are disposed on an upper portion of the counterweight 6. Rotating shafts of the first and second counterweight suspending sheaves 14*a* and 14*b* are horizontal and parallel to a depth direction of the car 4 (a thickness direction of the counterweight 6). The first and second counterweight suspending sheaves 14*a* and 14*b* are disposed so as to line up in the width direction of the counterweight 6 at vertically identical positions.

A counterweight-side return sheave 21 is supported on an upper portion of the counterweight-side supporting beam 17 by means of a second supporting arm 20 (omitted from FIG. 7). The counterweight-side return sheave 21 is disposed higher than the counterweight suspending sheaves 14*a* and 14*b* in the upper portion inside the hoistway 1.

A suspending means 12 (omitted from FIG. 7) is wound from the driving sheave 9, via the first sheave-side return sheave 19*a*, the second sheave-side return sheave 19*b*, and the counterweight-side return sheave 21, to the counterweight suspending sheaves 14*a* and 14*b*. The counterweight-side rope fastener portion 16 is disposed on the counterweight-side supporting beam 17 in a vicinity of the second counterweight guide rail 5*b*.

The suspending means 12 is wound from near the car-side end portion 12*a* sequentially around the first car suspending sheave 13*a*, the second car suspending sheave 13*b*, the driving sheave 9, the first sheave-side return sheave 19*a*, the second sheave-side return sheave 19*b*, the counterweight-side return sheave 21, the first counterweight suspending sheave 14*a*, and the second counterweight suspending sheave 14*b*. In other words, the car 4 is suspended using a two-to-one (2:1) roping method. The rest of the configuration is similar or identical to that of Embodiment 1.

According to a layout of this kind, the hoisting machine 8 is also disposed inside the hoistway 1 more efficiently, enabling horizontal and vertical space saving to be achieved in the hoistway 1.

Because the counterweight 6 is disposed behind the car 4, even if it is necessary to increase the width dimensions of the car 4 and reduce the depth dimensions of the car 4 due to customer requests or the like, spacing between the counterweight guide rails 5*a* and 5*b* can be widened and the thickness dimensions of the counterweight 6 reduced, enabling horizontal space saving to be achieved in the hoistway 1.

Moreover, in Embodiment 4, there may be a single sheave-side return sheave, or there may be two or more counterweight-side return sheaves. There may be a single counterweight suspending sheave.

In Embodiments 1 through 4, the hoisting machine supporting beam 7 or a frame for the hoisting machine 8 may be shipped before installation in a pre-mounted state on a portion of the second car guide rail 3*b*. A position adjusting operation during installation can thereby be facilitated, enabling work efficiency to be improved.

In addition, car suspending sheaves 13*a* and 13*b* according to Embodiment 4 may be disposed so as to be inclined relative to the car guide rail center line C1 in a similar or identical manner to that of Embodiment 3.

The invention claimed is:

1. An elevator apparatus comprising:

a car on which first and second car suspending sheaves are disposed, and that is raised and lowered inside a hoistway;

first and second car guide rails that are installed inside the hoistway so as to guide the raising and lowering of the car, each of the first and second car guide rails having a front surface that faces the car and a back surface that faces away from the car;

a counterweight on which a counterweight suspending sheave is disposed, and that is raised and lowered inside the hoistway;

first and second counterweight guide rails that are installed inside the hoistway so as to guide the raising and lowering of the counterweight;

a hoisting machine that includes:

a driving sheave; and a motor portion that rotates the driving sheave, the hoisting machine being disposed in an upper portion inside the hoistway so as to raise and lower the car and the counterweight;

a suspending means that includes a car-side end portion and a counterweight-side end portion, and that is wound sequentially around the first car suspending sheave, the second car suspending sheave, the driving sheave, and the counterweight suspending sheave to suspend the car and the counterweight;

a car-side rope fastener portion that is disposed in the upper portion inside the hoistway, and to which the car-side end portion is connected; and a counterweight-side rope fastener portion that is disposed in the upper portion inside the hoistway, and to which the counterweight-side end portion is connected, wherein:

the second car suspending sheave, the driving sheave, and the counterweight suspending sheave are disposed on a first side of a car guide rail center line that connects the first and second car guide rails when viewed from directly above;

a portion of the motor portion is disposed between the back surface of the second car guide rail and a hoistway side wall; and the driving sheave is disposed so as to overlap with the second car guide rail when viewed from a landing side.

2. The elevator apparatus according to claim 1, wherein the counterweight is disposed beside the car when viewed from directly above, and wherein at least a portion of the hoisting machine is disposed so as to overlap with the counterweight when viewed from directly above.

3. The elevator apparatus according to claim 2, wherein the counterweight is disposed on an identical side of the car guide rail center line to the driving sheave when viewed from directly above.

4. The elevator apparatus according to claim 2, wherein a portion of the counterweight is disposed between the second car guide rail and the hoistway side wall.

5. The elevator apparatus according to claim 2, further comprising a hoisting machine supporting beam that supports the hoisting machine, wherein the counterweight-side rope fastener portion is supported on a top surface of the hoisting machine supporting beam.

6. The elevator apparatus according to claim 5, wherein the hoisting machine supporting beam is supported by the second car guide rail and by the first and second counterweight guide rails.

7. The elevator apparatus according to claim 1, further comprising:

sheave-side return sheaves that are disposed lower than the driving sheave in the upper portion inside the hoistway; and a counterweight-side return sheave that is disposed higher than the counterweight suspending sheave in the upper portion inside the hoistway, wherein the counterweight is disposed rearward from the car when viewed from directly above, and wherein the suspending means being wound from the driving sheave, via the sheave-side return sheave and the counterweight-side return sheave, to the counterweight suspending sheave.

8. The elevator apparatus according to claim 1, wherein the first and second car suspending sheaves are disposed such that a portion of the suspending means that passes between the first and second car suspending sheaves is parallel to the car guide rail center line when viewed from directly above.

9. The elevator apparatus according to claim 1, wherein the second car suspending sheave is disposed on an opposite side of the car guide rail center line from the first car suspending sheave when viewed from directly above.

10. The elevator apparatus according to claim 1, wherein a diameter of the driving sheave is less than or equal to half of a diameter of the motor portion.

11. The elevator apparatus according claim 1, wherein the motor portion includes a first side that faces the car, and a second side that faces away from the car, wherein the driving sheave is disposed on the first side of the motor portion, and wherein an end surface of the second car guide rail that faces the car is closer to the car than an end surface of the driving sheave that faces the car.

12. The elevator apparatus according to claim 1, wherein the hoisting machine further comprises a brake that is disposed on an outer circumferential portion of the motor portion, and that brakes the rotation of the driving sheave, and wherein the driving sheave is located on a first side of the second car guide rail and the brake is located on a second side of the second car guide rail opposite from the first side so that the driving sheave and brake face each other from opposite sides of the second car guide rail when viewed from directly above.

* * * * *